US005106043A

United States Patent [19]

Solomon

[11] Patent Number: 5,106,043

[45] Date of Patent: Apr. 21, 1992

[54] SPRING AND LOCK SUPPORT FOR OVERBED TABLE

[75] Inventor: Robert A. Solomon, Kalamazoo, Mich.

[73] Assignee: AM Fab, Inc., Kalamazoo, Mich.

[21] Appl. No.: 647,496

[22] Filed: Jan. 29, 1991

Related U.S. Application Data

[63] Continuation of Ser. No. 294,757, Jan. 6, 1989, Pat. No. 5,016,846.

[51] Int. Cl.[5] ..... A47B 9/00

[52] U.S. Cl. ..... 248/161; 248/410; 108/146

[58] Field of Search ..... 248/161, 162.1, 410, 248/411, 412, 157, 413; 403/104, 109; 108/146, 144, 116, 117, 141

[56] References Cited

U.S. PATENT DOCUMENTS

| | | | |
|---|---|---|---|
| 2,495,674 | 4/1946 | Lewis | 248/410 |
| 3,286,663 | 5/1965 | Mann et al. | 248/410 X |
| 3,380,405 | 4/1968 | Barecki et al. | 108/146 X |
| 3,588,023 | 6/1971 | Cohen | 248/410 |
| 3,999,492 | 12/1976 | Emrick | 108/146 X |
| 4,191,438 | 3/1980 | Day | 248/412 |
| 4,601,246 | 7/1986 | Damico | 108/146 |
| 4,607,577 | 8/1986 | Leonardo | 248/410 X |

*Primary Examiner*—Karen J. Chotkowski
*Attorney, Agent, or Firm*—Price, Heneveld, Cooper, DeWitt & Litton

[57] ABSTRACT

A bedside table has a base with a vertical tube thereon, a tabletop with a vertical member slidably disposed in the tube, and a locking mechanism which can releasably lock the tube and vertical member against relative movement. The locking mechanism includes a vertical locking surface within the tube, a first positioning surface on the vertical support which faces the locking surface, second and third vertically spaced positioning surfaces facing each other at a location between the first positioning surface and the locking surface, and a plate-like locking member having a first edge portion disposed against the first positioning surface and extending away from the first positioning surface between the second and third positioning surfaces in a direction toward the locking surface, the locking member being pivotal about a horizontal axis in the region of the first positioning surface between locking and release positions in which a second edge portion thereof respectively engages and is spaced from the locking surface. A single spring can be used to both counterbalance the weight of the tabletop and vertical member and yieldably urge the locking member toward its locking position.

16 Claims, 3 Drawing Sheets

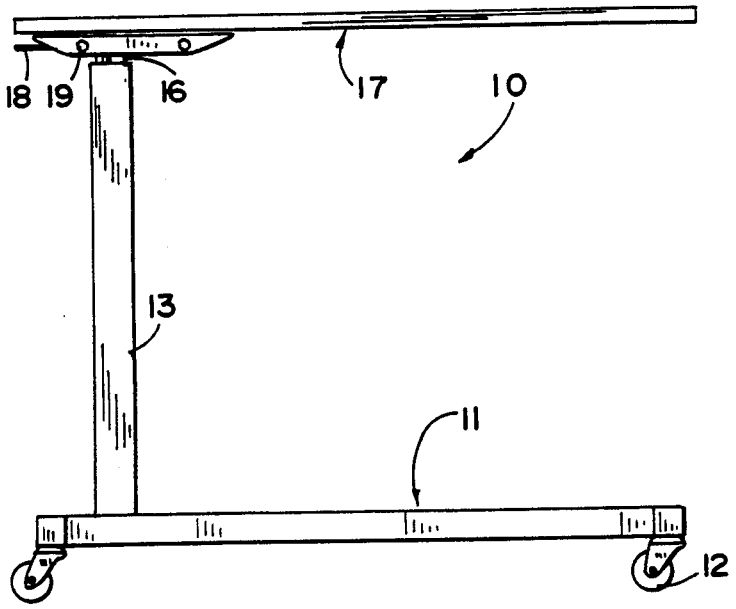
FIG. 1
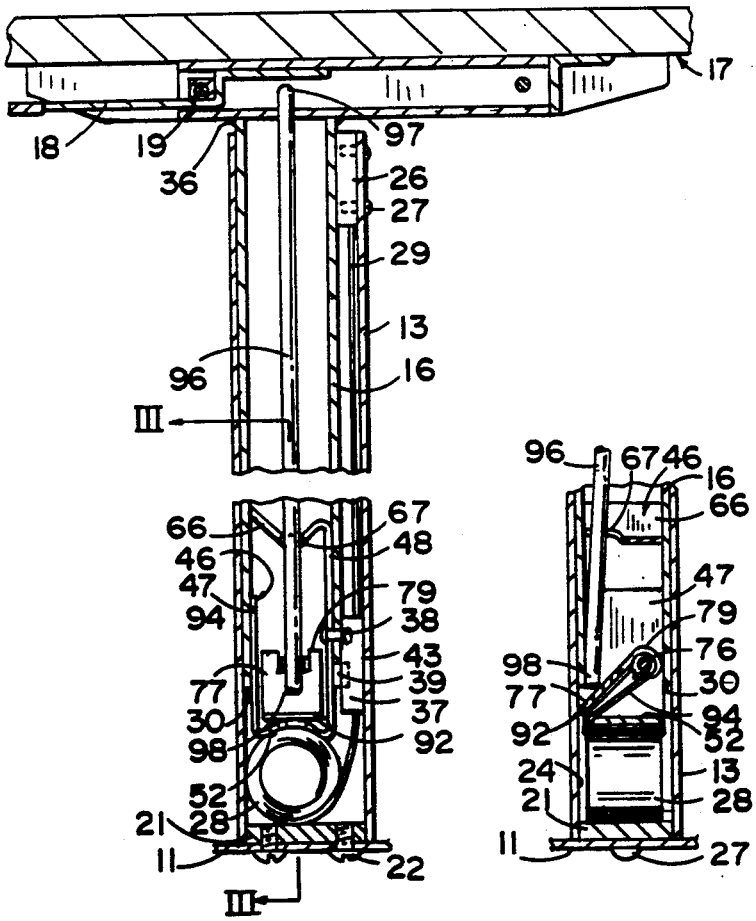
FIG. 2
PRIOR ART
FIG. 3
PRIOR ART
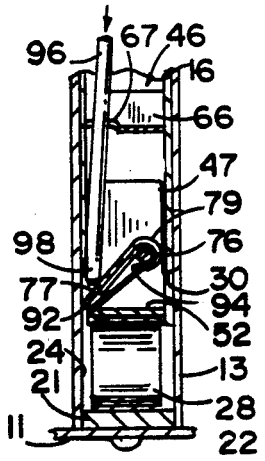
FIG. 4
PRIOR ART

SPRING AND LOCK SUPPORT FOR OVERBED TABLE

This is a continuation of application Ser. No. 07/294,757, filed Jan. 6, 1989, U.S. Pat. No. 5,016,846.

FIELD OF THE INVENTION

The invention relates to a bedside table and, more particularly, relates to an improvement in a locking mechanism for locking the tabletop in any vertical position throughout its range of movement.

BACKGROUND OF THE INVENTION

Bedside tables which may be raised and lowered have been utilized in hospitals and similar situations in which it is desirable to have a table which may be utilized by a person in a bed or chair. Such bedside tables have been conventionally constructed of a base having an upstanding post-like structure at one end and a tabletop with a support mounted on the upper end of the post-like structure to support the tabletop. A locking mechanism cooperable with the post-like structure and support permits the tabletop to be releasably locked with respect to the base in any vertical position throughout its range of movement.

Various locking mechanisms have previously been developed, for example the conventional locking mechanism shown in FIGS. 2–4 of the present application and described in detail hereinafter. A similar locking arrangement is disclosed in U.S. Pat. No. 3,999,492, the subject matter of which is hereby incorporated herein by reference. These prior locking mechanisms have provided a locking effect which is adequate for their intended purposes. However, they have not been satisfactory in all respects.

For example, they typically require several separate metal parts which must be fabricated separately and which are relatively expensive to fabricate. Further, the number of parts involved has made it relatively difficult to assemble the locking mechanism during manufacture of the table, thereby increasing the amount of labor required to assemble each table and thus the production cost of the table. Moreover, they typically require at least two separate springs for proper operation, which also increases costs.

It is thus an object of the present invention to provide an improved locking mechanism which functions as well as the prior mechanisms but which has fewer parts and cheaper parts and which is relatively simple to assemble.

It is a further object of the present invention to provide an improved locking mechanism, as aforesaid, which requires only one spring for proper operation.

It is a further object of the present invention to provide an improved locking mechanism, as aforesaid, which is rugged and durable and requires little or no maintenance.

SUMMARY OF THE INVENTION

Objects and purposes of the invention, including those set forth above, are met according to one form of the invention by providing an apparatus which includes an elongate tubular first member extending in a first direction and having therein an inwardly facing locking surface which extends lengthwise thereof, an elongate second member extending in the first direction and having a portion movable lengthwise within the tubular first member, and a locking arrangement which includes facing first and second positioning surface portions which face in respective directions lengthwise of the first member, and a third positioning surface portion on one of the first and second members which faces the locking surface and is disposed on a side of the first and second positioninq surface portions remote from the locking surface, a locking member which has a first edge portion disposed against the third positioning surface portion, which extends away from the third positioning surface portion and between the first and second positioning surface portions in a direction toward the locking surface, the locking member being movable about a pivot axis in the region of the first and second positioning surface portions between locking and release positions in which a second edge portion thereof respectively engages and is spaced from the locking surface.

According to another form of the invention, the apparatus includes an elongate tubular first member extending in a first direction and having therein an inwardly facing locking surface which extends in the first direction lengthwise of the first member, an elongate second member extending in the first direction and having a portion disposed within the tubular first member, the second member being movable reciprocally relative to the first member in the first direction and in a second direction opposite the first direction, a releasable locking arrangement which releasably holds the second member against movement in the first direction with respect to the first member, and a selectively actuable operating arrangement cooperable with the locking arrangement for effecting a release thereof. The locking arrangement includes a locking member having a locking edge portion and supported on the second member for movement between locking and release positions in which the locking edge portion is respectively engaging and spaced from the locking surface, the operating arrangement effecting movement of the locking member from its locking position to its release position when actuated. A spring is operatively coupled to the first member and yieldably urges the second member in the second direction relative to the first member and it yieldably urges the locking member toward its locking position.

BRIEF DESCRIPTION OF THE DRAWINGS

A conventional mechanism and three mechanisms embodying the invention will be described in detail hereinafter with reference to the drawings, in which:

FIG. 1 is a side elevational view of an overbed table embodying the invention;

FIG. 2 is a fragmentary sectional side view of a conventional overbed table and a conventional locking mechanism in a vertical guide post of the table;

FIG. 3 is a sectional view taken along the line III—III of FIG. 2;

FIG. 4 is a sectional view similar to FIG. 3 but showing a different operational position;

Figure 5:
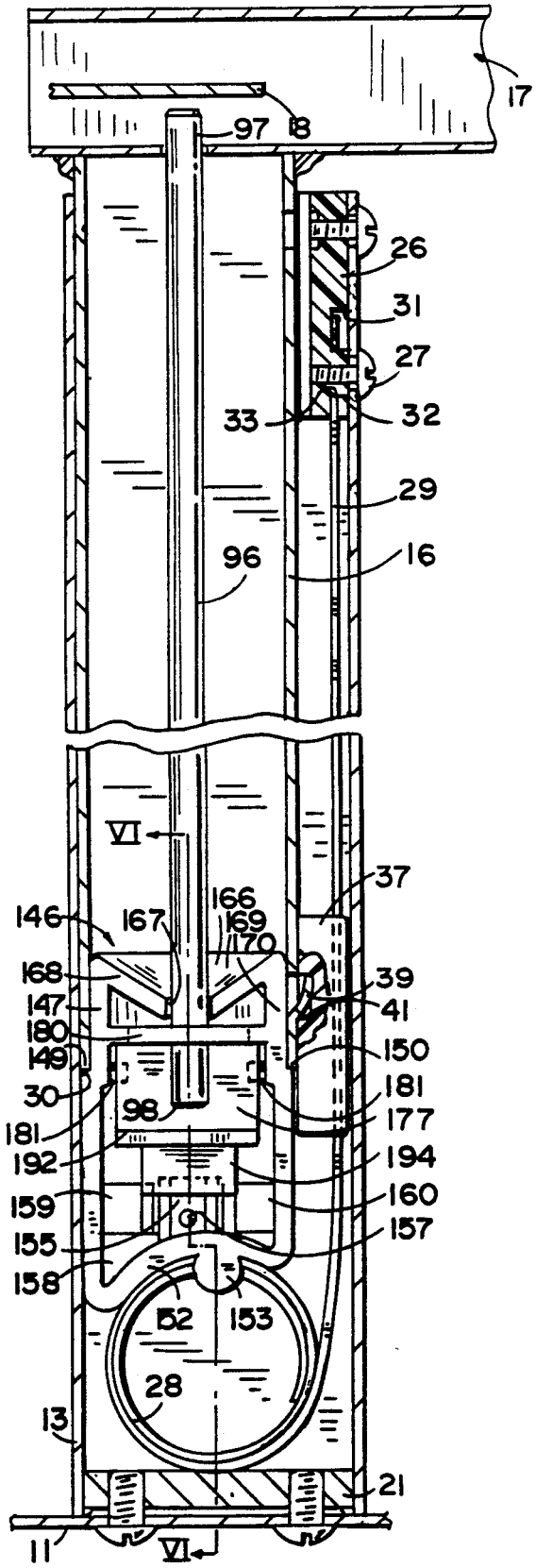
FIG. 5 is a fragmentary sectional side view of the table of FIG. 1.

Certain terminology will be used in the following description for convenience in reference only and will not be limiting. In particular, the words "up", "down", "right", and "left" will designate directions in the drawings to which reference is made. The words "in" and "out" will refer to directions respectively toward and away from the geometric center of the table and designated parts thereof. Such terminology will include the words specifically mentioned, derivatives thereof, and words of similar import.

DETAILED DESCRIPTION

Referring to FIG. 1, an overbed table 10 embodying the present invention includes a base 11 movably supported by wheels 12 and having a vertical outer tube member 13 of rectangular cross section fixedly supported thereon. A vertical inner tube member 16 has a rectangular cross sectional size less than that of the tube 13, and is vertically movably received within the tube 13. The upper end of the inner tube member 16 is secured to a tabletop 17. A releasable locking mechanism, which is not visible in FIG. 1 but will be described in detail below, is provided within the outer tube member 13 and partly within inner tube member 16, and can releasably secure the inner tube member 16 in a selected vertical position with respect to the outer tube member 13 so that the vertical position of the tabletop 17 can be varied while maintaining the tabletop 17 horizontal. The locking mechanism is normally actuated so as to prevent the inner tube member 16 from moving downwardly relative to the outer tube member 13, but can be manually released In particular, a manually operable control lever 18 is pivotally supported on a bolt 19 and, when the left end of the control lever 18 is manually pressed upwardly in FIG. 1, the pivotal movement of the control lever 18 about the bolt 19 effects a release of the locking mechanism in a manner described hereinafter.

Before describing the inventive locking mechanism which is present in the table of FIG. 1, a conventional and commercially available locking mechanism for a table of this type will be described with reference to FIGS. 2–4.

In FIG. 2, a rectangular plate 21 is fixedly secured in the lower end of the rectangular outer tube member 13 in a suitable manner, for example by welding or brazing. The plate 21 is fixedly secured to the table base 11 by screws 22. Referring to FIG. 3, the left wall of the rectangular outer tube member 13 has a vertically extending inner surface 24 which serves as a locking surface.

As shown in FIG. 2, a plate-like plastic stop member 26 is fixedly secured by screws 27 to an upper end of a wall of the outer tube member 13 which is adjacent and perpendicular to the wall having thereon the locking surface 24. A wall of the inner tube 16 slidably engages the stop member 26. A coil spring 28 is an elongate coiled metal strip having an end portion 29 which is fixedly secured to the stop member 26. More specifically, as best shown in FIG. 5, the stop member 26 has therein a recess 31 adjacent the wall of the tube 13 to which it is secured, and has a cylindrical projection 32 which projects across the recess to the wall of the tube. The threaded shank of the screw 27 cooperates with a threaded hole provided in the projection 32. The end portion 29 of the spring 28 has near its upper end an opening 33 through which the projection 32 extends in order to anchor the upper end 29 of the spring 28 to the stop member 26. From the end portion 29, and as shown in FIG. 2, the strip extends downwardly along the wall of the tube to which the stop member 26 is attached to the coiled portion of the spring, which is located below the lower end 30 of the inner tube member 16.

The upper end of the inner tube member 16 is secured to the tabletop 17 in an appropriate manner, for example by welding or brazing 36. A further plate-like plastic stop member 37 is located directly below the stop member 26 and is fixedly secured to a lower end of a wall of the inner tube member 16 by a rivet 38. A portion of the wall of tube member 16 is bent outwardly to create a vertically extending, laterally outwardly projecting tab 39 which extends into a congruent recess provided in the stop member 37. The outer surface 43 of the stop member 37 slidably engages the wall of the outer tube 13 on which the stop member 26 is mounted, and has therein a wide, shallow, vertically extending recess through which the end portion 29 of the coil spring 28 slidably extends so that the stop member 37 can move vertically with the inner tube member 16 free of frictional interference with the end portion 29 of spring 28.

An insert member 46 is made from a single bent metal strip, and includes spaced parallel vertical side walls 47 and 48, an arcuate lower end wall 52 extending between the lower ends of the side walls, and a V-shaped upper end wall 66 extending transversely away from the upper end of the side wall 48. The insert member 46 is disposed partly within the lower end of the inner tube member 16 and is fixedly secured in place by the rivet 38, the lower end wall 52 and the lower portions of the side walls 47 and 48 being located below the lower end 30 of the inner tube member 16. The arcuate lower end wall 52 slidably engages the coil of the spring 28. The upper end wall 66 has a slot 67 extending partly transversely across it at the apex of the V-shape.

Referring to FIG. 3, a horizontally extending axle 76 has its ends disposed in aligned openings which are provided in the side walls 47 and 48 just above the lower end 30 of the inner tube member 16. The side walls 47 and 48 are each disposed against a respective wall of the inner tube member 16, whereby axial movement of the axle 76 is prevented by engagement of each end of the axle with a respective wall of the inner tube member 16. A locking member 77 is made from a flat metal plate and has at one end two spaced and outwardly projecting strips 79 which are each bent to a cylindrical shape, the axle 76 extending through the cylindrical portion of the locking member 77 defined by the strips 79. The locking member 77 can thus pivot on the axle 76 between a locking position and a release position which are respectively shown in FIGS. 3 and 4 and in which an edge portion 92 of the locking member 77 is respectively engaging and spaced slightly from the locking surface 24 on the outer tube member 13. A bent wire torsion spring 94 is provided on the axle 76 between the bent strips 79 of the locking member 77, and has two legs which respectively engage the locking member 77 and the lower end wall 52 of the insert member 46 so as to continuously yieldably urge pivotal movement of the locking member 77 toward the locking position shown in FIG. 3.

An elongate cylindrical operating rod 96 is vertically movably supported within the inner tube member 16 and extends through the guide slot 67. The rod 96 has an upper end 97 which is located immediately below the right end of the manual control lever 18, and has a lower end 98 which, as shown in FIG. 3, slidably engages an inner surface of tube 16 and contacts the upper surface of the locking member 77.

Figure 7:
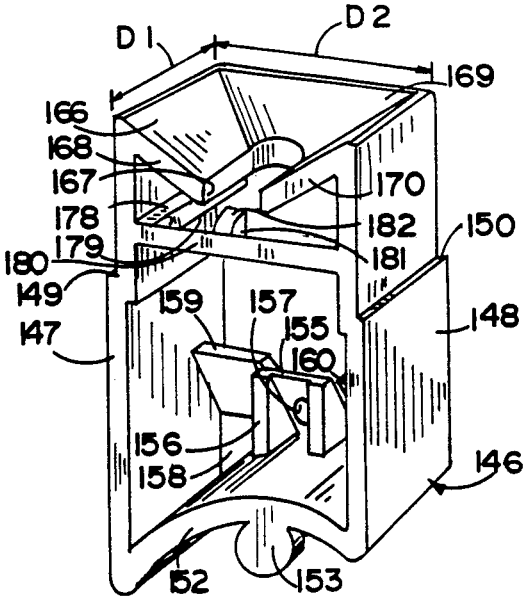
FIG. 7 is a perspective view of an insert member which is a component of the embodiment shown in FIG. 5.
Figure 6:
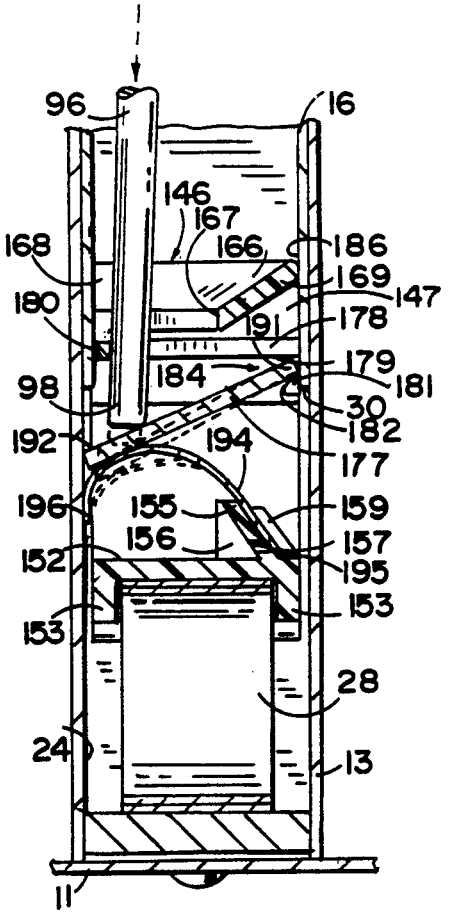
FIG. 6 is a sectional view taken along the line VI—VI in FIG. 5.

FIGS. 5–7 depict a first embodiment of the locking mechanism according to the invention. Components which are the same as or similar to components in the embodiment of FIGS. 1–4 are designated with the same or with similar reference numerals. The following discussion will focus on structural differences.

Referring to FIG. 5, the bent tab 39 at the lower end lo of the inner tube member 16 is rigid and extends upwardly and outwardly at an angle to the tube wall from which it projects, and is received in a rectangular recess 41 provided in the stop member 37.

Inserted partway into the lower end of the inner tube member 16 is an insert member 146, which is shown by itself in FIG. 7. The insert member 146 is a single integral molded plastic part. The insert member 146 has two spaced vertical side walls 147 and 148 which each have a respective upwardly facing step 149 or 150 on the outer surface thereof, the steps 149 and 150 each engaging the lower end 30 of the inner tube member 16 so as to prevent upward movement of the insert member 146 relative to the tube member 16. The insert member 146 has an arcuate lower end wall 152 extending between the lower ends of the side walls 147 and 148, and the end wall 152 has two tabs 153 of approximately circular shape which each project downwardly from a respective axial end of the end wall 152. The lower end wall 152 has projecting upwardly therefrom an inclined flange 155 which is prevented from flexinq by two spaced triangular buttress supports 156. The flange 155 is provided on the wall 152 near one axial end thereof, and has an opening 157 provided therethrough. A wall 158 has two sections which project upwardly from respective portions of the axial end of the lower end wall 152 nearest the base of the flange 155 to a level approximately equal to the highest point on the arcuate lower end wall 152. Two spaced flanges 159 and 160 project upwardly from the upper end of the wall 158 at the same angle as the flange 155. The flanges 159 and 160 are coplanar with each other but are offset axially along the arcuate end wall 152 with respect to the flange 155 so that, when viewed as shown in FIG. 6, there is a small gap between the flange 155 and the flanges 159 and 160.

The insert member 146 also has an upper end wall 166 which extends between the upper ends of the side walls 147 and 148 and which has a guide slot 167 extending approximately halfway thereacross from one side thereof. The upper end wall 166 includes three wall portions 168, 169 and 170 which each extend outwardly and upwardly in respective directions from the slot 167. The portion of the insert member 146 above the steps 149 and 150 is of rectangular shape and has outside dimensions D1 and D2 which are approximately equal to the inside dimensions of the inner tube member 16, so that the upper end of the insert member 146 is snugly force-fit into the lower end of the tube member 16.

Each of the side walls 147 and 148 of the insert member 146 has, at a location above the steps 149 and 150 and below the upper end wall 166, a respective inwardly projecting flange 178 which extends horizontally the full width of the side wall 147 or 148. Each flange has on the underside thereof a downwardly facing positioning surface 179. A brace 180 of triangular cross section extends horizontally between the two flanges at one end thereof and is slidably engaged by the lower end of the rod 96. Each of the side walls 147 and 148 also has, a small distance below the end of each flange 178 remote from brace 180, a sector-shaped inward projection 181 having thereon an upwardly facing arcuate positioning surface 182. The tube member 16 has an inner surface 186 which serves as a positioning surface. Referring to FIG. 6, a recess 184 is defined adjacent each of the side walls 147 and 148 of the insert member 146 by the surfaces 179 and 182 on the flange 178 and projection 181 and by the surface 186 of the tube member 16.

A locking member 177 is a flat plate having on one side thereof an edge portion 191 which has its opposite ends disposed in the recesses 184 and having on the opposite side thereof a locking edge 192 which bears against the locking surface 24 on the outer tube member 13. The edge portion 191 is sufficiently loosely received in the recesses 184 so that the locking member 177 can carry out limited pivotal movement about a horizontal axis which is adjacent and parallel to its edge portion 191, the locking member 177 pivoting between a locking position shown in FIG. 6 in which the edge portion 192 engages the locking surface 24 and a not-illustrated release position in which the edge portion 192 is spaced slightly from the locking surface 24.

A metal leaf spring 194 has one end 195 (FIG. 6) inserted in the gap between the flange 155 and flanges 159 and 160, and the other end 196 is flexed slightly downwardly. A portion of the leaf spring near the end 196 engages the underside of the locking member 177 and continuously yieldably urges the locking member 177 to pivot upwardly to its locking position. Although not the case here, it is possible to provide a rivet through the opening 157 and leaf spring 194 in order to securely fasten the leaf spring to the insert member.

Figure 8:
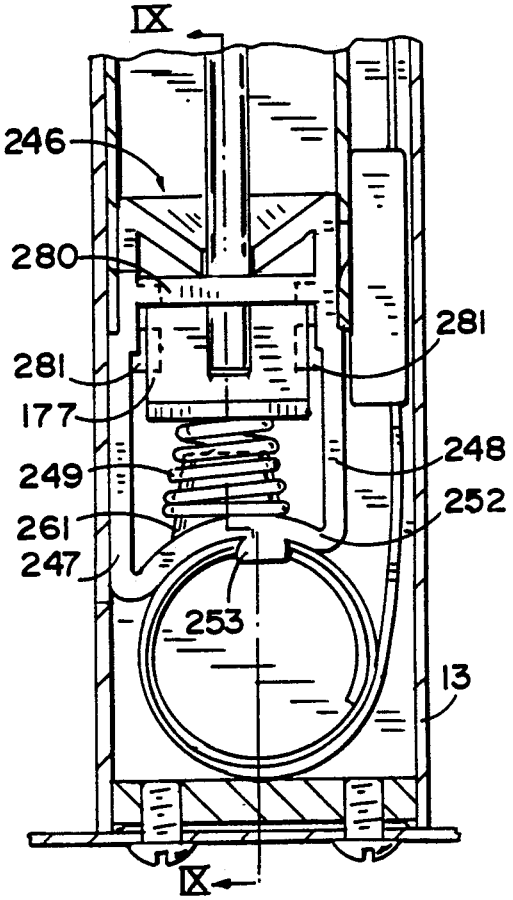
FIG. 8 is a fragmentary sectional side view similar to FIG. 5 but showing an alternative embodiment of the insert member.
Figure 9:
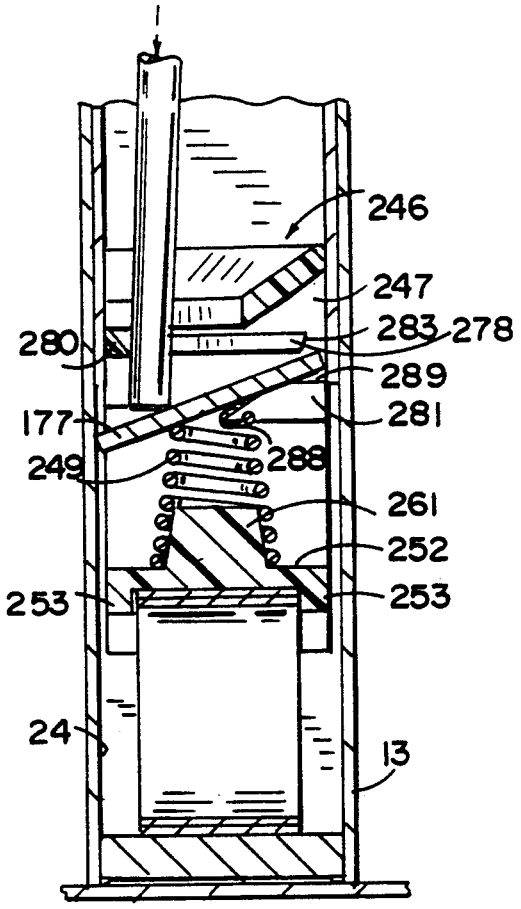
FIG. 9 is a sectional view taken along the line IX—IX of FIG. 8.

Turning now to FIGS. 8 and 9, an alternative embodiment of the inventive locking mechanism is illustrated. The embodiment of FIGS. 8 and 9 is identical to the embodiment of FIGS. 5–7, except as specifically described below.

The embodiment of FIGS. 8 and 9 includes a plastic insert member 246 which is identical to the insert member 146 except as follows. First, the two spaced tabs 253 projecting downwardly from the arcuate lower end wall 252 are of semi-circular shape rather than circular shape. Further, the arcuate lower end wall 252 does not have on the upper side thereof the wall 158, flanges 155, 159 and 160, or the buttress supports 156 which were present in the embodiment of FIGS. 5–7. Instead, the arcuate lower end wall 252 has in the center thereof an upwardly extending frustoconical projection 261. The circular cross section of the projection 261 tapers in diameter upwardly. A helical spring 249 has a lower end encircling the frustoconical projection 261 and has an upper end disposed against the underside of the locking member 177. The diameter of the spring 249 tapers progressively from its lower end to its upper end, although it could alternatively be a non-tapered spring.

The side walls 247 and 248 of the insert member 246 each have thereon the horizontal flange 278, but as shown in FIG. 9 the end of each flange 278 remote from the brace 280 does not extend all the way to the edge of the side wall. Instead, each flange 278 has an end surface 283 which is spaced slightly from the edge of the associated side wall and is inclined slightly with respect to a vertical reference so as to face rightwardly and downwardly in FIG. 9. Further, the projections 281 below the flanges 278 are not sector-shaped in this embodiment, but instead are somewhat wedge shaped, and each have an upwardly facing surface portion 288 which extends upwardly and away from the locking surface 24 on tube member 13 and merges into a horizontal upwardly facing surface portion 289. The end 283 of flange 278 is disposed above the surface portion 289 near the intersection of surface portions 288 and 289.

Figure 10:
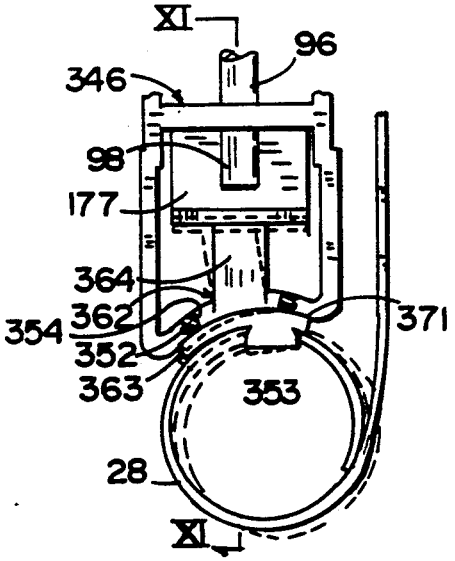
FIG. 10 is a fragmentary side view similar to FIG. 5 of yet another alternative embodiment, but with the inner and outer tube members omitted for clarity.
Figure 11:
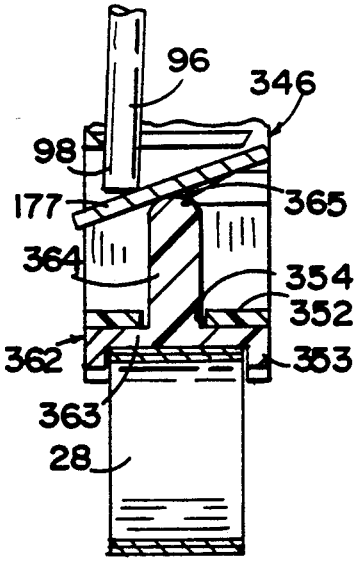
FIG. 11 is a sectional view taken along the line XI—XI in FIG. 10.

Turning now to FIGS. 10 and 11, a further alternative embodiment of the inventive locking mechanism is illustrated. The embodiment of FIGS. 10 and II is identical to the embodiment of FIGS. 8 and 9, except as specifically described below.

The embodiment of FIGS. 10 and 11 includes a plastic insert member 346 which is identical to the insert member 246, except that the arcuate bottom wall 352 thereof has provided therethrough a slot-like opening 354 which extends in a direction circumferentially of the arcuate bottom wall 352. Further, the arcuate bottom wall 352 does not have downwardly protecting tabs similar to those shown at 253 in FIG. 8.

A plastic spring support member 362, which is physically separate from the insert member 346, has an arcuate support wall 363 disposed just below and exhibiting approximately the same curvature as the bottom wall 352 of insert member 346. The arcuate support wall 363 has its lower side slidably engaging the coil of spring 28, and has two spaced, downwardly projecting tabs 353 which the coil of spring 28 is located axially between. The support member 362 has a rectangular vertical post 364 which projects upwardly from the center of the support wall 363 and which has a semispherical upper end 365. The post 364 extends slidably through the opening 354 provided in the end wall 352 of insert member 346, and has its upper end 365 disposed slidably against a central portion of the underside of the locking member 177.

OPERATION

Each of the disclosed overbed tables are operated in a similar manner. For convenience, the operation thereof will be described with reference to the embodiment of the invention illustrated in FIGS. 5–7.

Referring to FIG. 5, upward vertical movement of the tabletop 17 and inner tube member 16 relative to the outer tube member 13 is limited by engagement of the stop member 37 with the stop member 26, whereas downward movement of the tabletop 17 and tube member 16 is limited by engagement of the coil spring 28 with the plate 21. The coil spring 28 continuously attempts to completely coil itself, so that the coil is always attempting to move upwardly within the outer tube member 13, as a result of which the coil spring 28 exerts an upward force on the insert member 146 and thus the inner tube member 16 and tabletop 17. This upward force is preferably somewhat less than the combined weight of the tabletop 17 and tube member 16, so that a person using the table can easily move the tabletop 17 upwardly with the application of a relatively small manual upward force.

Normally, the control lever 18 (FIGS. 1 and 5) is not manually actuated, and the leaf spring 194 can thus move the locking member 177 and operating rod 96 upwardly until the locking edge 192 of the locking member 177 is engaging the locking surface 24 on the outer tube member 13. Consequently, the portion of the downward force produced by the weight of the tabletop 17 and inner tube member 16 which is in excess of the upward force produced by the spring 28 urges the locking member 177 to pivot clockwise in FIG. 6 about an axis in the region of its edge portion 191, thereby producing a wedging effect which urges walls of the tubes 13 and 16 together to produce friction which prevents the inner tube member 16 from moving downwardly within the outer tube member 13.

When the user wishes to adjust the vertical position of the tabletop 17, he or she presses the left end of the control lever 18 upwardly, so that the right end thereof moves downwardly and forces the operating rod 96 to move downwardly, the lower end 98 of the operating rod forcing the locking member 177 to pivot counterclockwise against the force of the leaf spring 194 from the locking position shown in FIG. 6 to its unlocking position in which the locking edge 192 is spaced from the locking surface 24. Then, while manually holding the control lever 18 in this actuated position, the user moves the tabletop 17 upwardly or downwardly to a desired position, and then releases the control lever 18. The manual release of the control lever 18 permits the leaf spring 194 to move the locking member 177 and operating rod 96 upwardly until the locking edge 192 again engages the locking surface 24, thereby reinstituting the wedging effect which prevents downward movement of the tabletop 17 and inner tube member 16 relative to the outer tube member 13.

The embodiments of FIGS. 2–4 and FIGS. 8 and 9 operate in substantially the same manner as that just described, and a detailed explanation of their operation is believed unnecessary.

In the embodiment of FIGS. 10 and 11, when the user manually presses the control lever 18 so that the lower end 98 of the operating rod 96 moves down and causes the locking member 177 to pivot counterclockwise about its right end as viewed in FIG. 10, the locking member 177 urges the post 364 of the support member 362 downwardly, as a result of which the support member 362 pivots relative to the wall 352 of insert member 346 about a line 371 which extends perpendicular to the plane of FIG. 10. Thus, the support member 362 is moved from the position shown in solid lines in FIG. 10 to the position shown in broken lines against the urging of the coil spring 28, which in turn causes the coil spring 28 to be moved from the position shown in solid lines to the position shown in broken lines. Of course, the coil spring 28 will be yieldably urging the support member 362 to pivot back to its original position and thus pivot the locking member 177 clockwise from its unlocking position shown in broken lines in FIG. 10 to its locking position shown in solid lines. It should be noted that, whereas the embodiment of FIG. 6 uses the coil spring 28 and leaf spring 194 to respectively perform two different functions, the embodiment of FIGS. 10 and 11 uses only the coil spring 28 to perform both functions.

Although three preferred embodiments of the invention have been shown in detail for illustrative purposes, it will be recognized that variations or modifications thereof, including the rearrangement of parts, lie within the scope of the present invention.

The embodiments of the invention in which an exclusive property or privilege is claimed are defined as follows:

1. An apparatus comprising: an elongate tubular first member extending in a first direction and having therein an inwardly facing locking surface which extends in said first direction lengthwise of said first member; an elongate tubular second member extending in said first direction and having a portion disposed within said tubular first member, said second member being movable reciprocally relative to said first member in said first direction and in a second direction opposite said first direction; an insert member having a portion disposed within an end portion of said elongate tubular second member, said insert member having thereon first and second positioning surface portions, said first positioning surface portion facing approximately in said first direction and said second positioning surface portion facing approximately in said second direction and being spaced in said first direction from said first positioning surface portion; a locking member positioned between said first and second positioning surface portions cooperable with said first and second members for releasably holding said second member against movement in said first direction with respect to said first member; said locking member including a locking edge portion for engaging said locking surface on said first tubular member; said locking member being movable about a pivot axis, which is in the region of said firs and second positioning surface portions and is approximately parallel to said locking surface, between a locking position in which said locking edge portion thereof engages said locking surface and a release position in which said locking edge portion thereof is spaced from said locking surface, said locking edge of said locking member moving approximately in said first direction as said locking member moves away from the locking position toward the release position; and selectively actuable operating means cooperable with said locking member for effecting a release thereof; said operating means, when actuated, effecting movement of said locking member from the locking position to the release position; means for moving said locking member from its release position to its locking position when said operating means is deactuated; and a second member biasing means operatively coupled to said first member and said second member which yieldably urges said second member in said second direction relative to said first member.

2. An apparatus according to claim 1, wherein said insert member has two side walls which are spaced from each other in a third direction transverse to said first direction and approximately parallel to said locking surface, each said side wall having thereon a flange and a projection which project toward the other side wall, each said flange having thereon a respective part of said first positioning surface portion and each said projection having thereon a respective part of said second positioning surface portion.

3. An apparatus according to claim 2, wherein each said projection is sector-shaped and has there an arcuate surface portion, said arcuate surface portion including said part of said second positioning surface portion on such projection.

4. An apparatus according to claim 2, wherein said part of said second surface portion on each said projection includes a first surface section which extends directly toward said locking surface approximately perpendicular thereto and which then merges into a second surface section which extends toward said locking surface and in said first direction at an angle to said locking surface.

5. An apparatus according to claim 2, wherein each said flange extends substantially all the way to said locking surface and is substantially perpendicular to said locking surface.

6. An apparatus according to claim 5, wherein an end of each said flange remote from said locking surface is adjacent said positioning surface on said second member.

7. An apparatus according to claim 2, wherein said insert member includes a brace extending between said side walls thereof adjacent said locking surface, and wherein said operating means includes an elongate operating rod which extends through said tubular members and has an end portion which engages said locking member at a location in the region of said locking edge thereof, said operating rod being reciprocally movable in lengthwise directions, extending away from said locking member approximately in said second direction, and having a portion which slidably engages said brace.

8. An apparatus according to claim 7, wherein said insert member has an end wall which extends between ends of said side walls and is spaced in said second direction from said locking member, said end wall having therethrough a guide opening and said operation rod extending slidably through said guide opening.

9. An apparatus according to claim 8, wherein said guide opening is a slot which extends partway into said end wall from a location along a first edge thereof and intermediate said side walls, and wherein said end wall includes two wall portions which are each inclined to extend inwardly and in said fist direction from each said sidewall to said slot and includes a third wall portion which is inclined to extend inwardly and in said first direction from a second edge of said end wall opposite said first edge to an inner end of said slot.

10. An apparatus according to claim 9, including a further end wall extending between ends of said side walls remote from said first-mentioned end wall and having thereon spring support means, and wherein said means for moving said locking member from its release position to the locking position includes a lock biasing spring supported by said spring support means and operatively engaging said locking member, said lock biasing spring yieldably urging movement of said locking member toward the locking position.

11. An apparatus according to claim 10, wherein said lock biasing spring is a leaf spring and wherein said spring support includes a first flange engaging an end portion of said leaf spring on one side thereof and includes two spaced second flanges engaging said end portion of said leaf spring on a side thereof opposite from said first flange.

12. An apparatus according to claim 10, wherein said spring support is a frustoconical projection which projects in said second direction from said further end wall, and wherein said lock biasing spring is a helical compression spring which has a first end encircling said frustconical projection and has a second and disposed against said locking member, said lock biasing spring having a diameter which tapers progressively from said first end thereof to said second end thereof.

13. An apparatus according to claim 10, wherein said further end wall is arcuate and has two tabs at axially spaced locations thereon which project therefrom in said first direction, and said second member biasing means including a coil spring which is an elongate metal strip which resiliently attempts to coil itself, said coil spring having a coiled portion which engages said arcuate further end surface of said insert member and having a portion which extends away from said coil substantially in said second direction and which has an end fixedly secured to said tubular first member, said coil spring resiliently urging said insert member and said second tubular member in said second direction.

14. An apparatus according to claim 10, wherein said insert member is a single integral part made of a plastic material.

15. An apparatus according to claim 2, wherein said insert member includes an end wall which is spaced in said first direction from said locking member and which extends between respective ends of said side walls, said end wall having spring support means thereon, and wherein said means for moving said locking member from the release position to the locking position includes a lock biasing spring which is supported by said spring support means on said end wall and which engages said locking member and continuously yieldably urges movement of said locking member toward the locking position.

16. An apparatus according to claim 1, wherein said locking member is a flat metal plate.

* * * * *

UNITED STATES PATENT AND TRADEMARK OFFICE

CERTIFICATE OF CORRECTION

PATENT NO. : 5,106,043

DATED : April 21, 1992

INVENTOR(S) : Robert A. Solomon

It is certified that error appears in the above-indentified patent and that said Letters Patent is hereby corrected as shown below:

Column 2, Line 7:

"positioninq" should be --positioning--.

Column 3, Line 42:

After "released" insert --.--.

Column 5, Line 20:

Before "of the" delete --lo--.

Column 5, Line 40:

"flexinq" should be --flexing--.

Column 7, Line 21:

"10 and II" should be --10 and 11--.

Column 9, Line 31, Claim 1:

"firs" should be --first--.

Column 9, Line 62, Claim 3:

"there" should be --thereon--.

UNITED STATES PATENT AND TRADEMARK OFFICE

CERTIFICATE OF CORRECTION

PATENT NO. : 5,106,043

DATED : April 21, 1992

INVENTOR(S) : Robert A. Solomon

It is certified that error appears in the above-indentified patent and that said Letters Patent is hereby corrected as shown below:

Column 10, Line 36, Claim 9:

"fist" should be --first--.

Column 10, Line 63, Claim 12:

"frustconical" should be --frustoconical--.

Column 10, Line 63, Claim 12:

"second and" should be --second end--.

Signed and Sealed this

Twenty-first Day of March, 1995

*Attest:*

Bruce Lehman

BRUCE LEHMAN

*Attesting Officer*

*Commissioner of Patents and Trademarks*